US006779857B2

(12) United States Patent
Waisbrod et al.

(10) Patent No.: US 6,779,857 B2
(45) Date of Patent: Aug. 24, 2004

(54) STORAGE STRUCTURE AND DOOR STRUCTURE

(75) Inventors: Neville Waisbrod, Wellington (NZ); Kent Wallace Parker, Wellington (NZ); Lyall Stewart, Porirua (NZ); Peter Alan Tierney, Upper Hutt (NZ)

(73) Assignee: Formway Furniture Limited, Wellington (NZ)

( * ) Notice: Subject to any disclaimer, the term of this patent is extended or adjusted under 35 U.S.C. 154(b) by 143 days.

(21) Appl. No.: 10/047,770

(22) Filed: Jan. 15, 2002

(65) Prior Publication Data

US 2002/0093275 A1 Jul. 18, 2002

(30) Foreign Application Priority Data

Jan. 15, 2001 (NZ) ..... 509371

(51) Int. Cl.[7] ..... A47B 88/00

(52) U.S. Cl. ..... 312/322; 312/325; 312/326; 312/329

(58) Field of Search ..... 312/325, 326, 312/329, 109, 110, 139.1, 323, 322, 297; 211/188, 186; 108/106, 50.02; 49/254; 220/811, 812; 160/201, 206

(56) References Cited

U.S. PATENT DOCUMENTS

| | | | | |
|---|---|---|---|---|
| 882,207 A | * | 3/1908 | McComb | 312/233 |
| 3,019,486 A | | 2/1962 | Stinson | |
| 3,212,464 A | | 10/1965 | Steuer | |
| 3,860,307 A | | 1/1975 | Fostel | |
| 3,881,794 A | | 5/1975 | Henning | |
| 3,995,563 A | | 12/1976 | Blunden | |
| 4,027,715 A | | 6/1977 | Tohma | |
| 4,218,104 A | | 8/1980 | Anderson et al. | |
| 4,325,597 A | | 4/1982 | Morrison | |
| 4,399,913 A | | 8/1983 | Gelardi et al. | |
| 4,407,319 A | | 10/1983 | Shultz et al. | |
| 4,681,379 A | | 7/1987 | Pillinini | |

(List continued on next page.)

FOREIGN PATENT DOCUMENTS

| | | |
|---|---|---|
| FR | 2 373 254 | 7/1978 |
| GB | 593584 | 10/1947 |

*Primary Examiner*—Peter M. Cuomo
*Assistant Examiner*—Erika Garrett
(74) *Attorney, Agent, or Firm*—Workman Nydegger

(57) ABSTRACT

A door structure includes a door frame having edge portions of which at least some are curved. The door structure further includes a flexible door panel which is pivotable between an open configuration and a closed configuration. The door panel is resiliently deformable from a substantially flat configuration to a curved configuration which corresponds to the curvature of the curved edge portions of the door frame. In the closed configuration the door panel is adapted to adopt the curved configuration and in the open position, the door panel is freely straightenable to the substantially flat configuration. The door structure may be embodied in a storage structure which includes a framework defining an interior including a storage space and an opening to the storage space. The door panel may be hingedly connected to an auxiliary portion which is slidably mounted substantially within the interior of the framework.

17 Claims, 9 Drawing Sheets

U.S. PATENT DOCUMENTS 4,903,433 A 2/1990 Baus
4,976,502 A 12/1990 Kelley et al.
5,060,705 A 10/1991 Woodward et al.
5,066,080 A 11/1991 Woodward et al.
5,078,461 A 1/1992 Beck et al.
5,115,855 A 5/1992 Lindblom et al.
5,131,449 A 7/1992 Winn et al.
5,217,289 A 6/1993 Woodward et al.
5,255,970 A * 10/1993 Theosabrata ..... 312/297
5,302,013 A 4/1994 Reiner
5,520,451 A 5/1996 Oshima
5,584,547 A 12/1996 Trulaske, Sr.
5,682,936 A 11/1997 Higdon, Jr.
5,893,616 A * 4/1999 MacDonald et al. ..... 312/245
5,902,025 A * 5/1999 Yu ..... 312/109
5,921,394 A 7/1999 Shroff
6,052,932 A 4/2000 Reddig et al.
6,102,503 A * 8/2000 Hwang ..... 312/321.5
6,126,239 A 10/2000 Hazzard
6,206,495 B1 * 3/2001 Peterson ..... 312/283
6,220,681 B1 4/2001 Swenson et al.
6,247,272 B1 6/2001 Shipman
6,454,370 B1 * 9/2002 Mosnik ..... 312/223.3
6,591,555 B2 * 7/2003 King et al. ..... 52/36.5
6,669,315 B2 * 12/2003 Heidmann et al. ..... 312/352

* cited by examiner

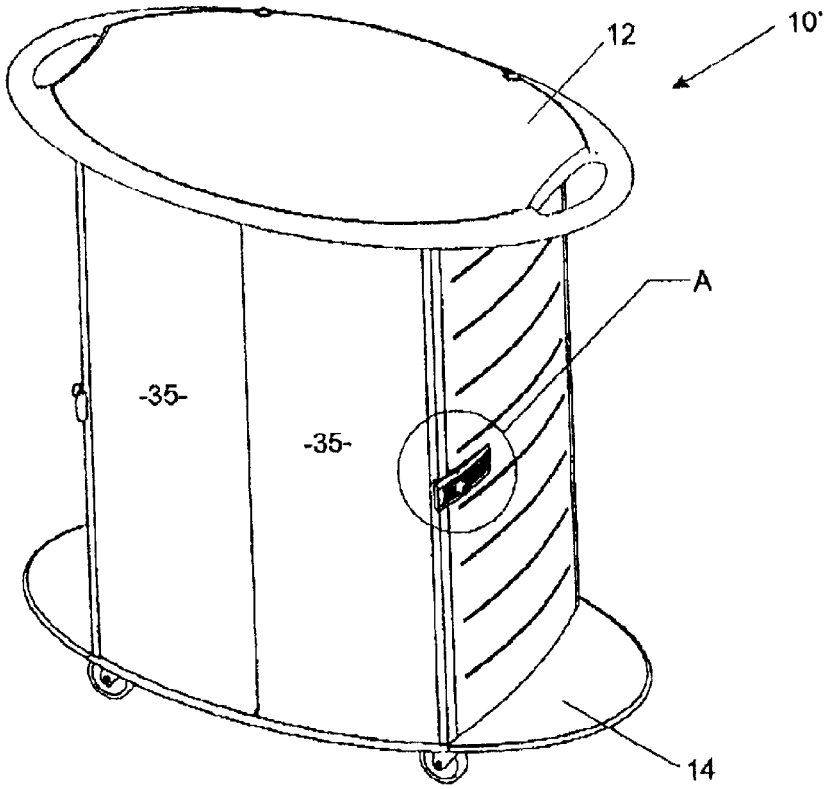
FIGURE 11
FIGURE 19
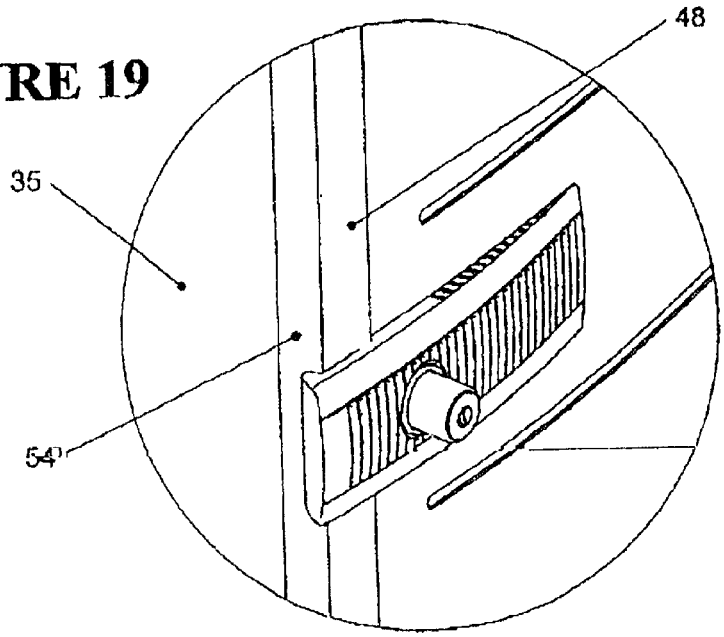

STORAGE STRUCTURE AND DOOR STRUCTURE

CROSS-REFERENCE TO RELATED APPLICATIONS

The present application claims priority to New Zealand Application No. 509,371, filed Jan. 15, 2001, which is hereby incorporated by reference.

BACKGROUND OF THE INVENTION

1. The Field of the Invention

The present specification relates to a storage structure which has pocketing doors. In particular, although not exclusively, the invention relates to a storage structure having a curved shape with the doors also being conformable to the curved shape. The specification also relates to a door structure whereby the door panel is conformable to a curved configuration. The present specification describes the invention in terms of a small mobile cabinet for office equipment but the invention will have application to other types of furniture including in-built furniture and domestic furniture. Additionally, some aspects of the invention may also have application to doors for buildings.

2. The Relevant Technology

With the re-emergence of curved profiles in furniture forms in the latter part of the twentieth century, the difficulty arises in regard to doors for such curved furniture forms. Curved doors have in the past been made by steaming timber into the required shape. However, this is time-consuming and the technique is limited to doors constructed of timber. Furthermore, curved doors are typically difficult to move into a stowage position when a compact furniture unit is required.

Accordingly, it is an object of the present invention to provide a storage structure which addresses at least some of the foregoing disadvantages and/or provides the public with a useful choice.

SUMMARY OF THE INVENTION

In accordance with a first aspect of the present invention there is provided a storage structure including: a framework defining an interior including a storage space and an opening to the storage space wherein the framework includes a curved contour; and a closure comprising: an auxiliary portion which is slidably mounted substantially within the interior of the framework; and a door panel hingedly connected to the auxiliary portion by means of a hinge portion whereby the door panel is pivotable about the hinge portion from a closed position in which the door panel at least partially covers the opening to an open position, and movable from the open position to a pocketed position in which the door panel is at least partially received within the interior of the framework, wherein the door panel is resiliently deformable to adopt a curved configuration conforming to the curved contour of the framework.

In a particularly preferred form of the invention, the door panel and the auxiliary panel may be integrally formed. In particular, the door panel and the auxiliary panel may comprise a unitary plastic sheet. Suitably, the divide between the door panel and the auxiliary panel in the unitary plastic sheet is defined by the hinge portion. Most preferably the hinge portion is a live hinge comprising a region of reduced thickness in the plastic sheet.

However, the auxiliary portion is not limited to being in the form of a panel and may simply comprise lugs or sliders which are connected to the door panel and are slidably mounted within the interior of the framework.

The interior storage structure may be further provided with a cavity open at the front within which the auxiliary portion is slidably mounted and into which the door panel is movable when in the pocketed position. The cavity may be defined by two internal walls, the inner one relative to the opening defining a hinging edge. The door panel and the auxiliary portion may be extendible from the cavity until the hinge is aligned with the hinging edge. Most preferably, a stop is provided to limit the outward travel of the door panel and the auxiliary portion from the cavity.

Preferably one or more guides are provided to facilitate the sliding travel of the auxiliary portion and/or the door panel. However in a most preferred form of the invention only the auxiliary portion is slidably mounted to the one or more guides with the door panel being free of the one or more guides.

In a most preferred form of the invention, the cavity to receive the door panel in the pocketed position is rectilinear and the flexible door panel can be straightened to be received with the cavity. The door panel may be of any construction enabling it to adopt a curved configuration or a configuration approximating a curved configuration. For example, the door panel may be constructed of interconnected sections in a manner similar to a tambour door. However, in a most preferred form of the invention the door panel is in the form of a resiliently deformable plastic sheet. As mentioned above, the door panel may also be integral with the auxiliary panel within a unitary plastic sheet.

A retainer may also be provided to retain the door in the closed position especially in view of the embodiment of a flexible door panel. Accordingly, one or more first engagement portions may be provided on the outer edge of the door panel with one or more cooperable second engagement portions provided on a corresponding part of the door structure. The first and second engagement means may be continuous along the outer edge and on the corresponding part of the door frame. For example, hook and loop fastener may be used as the retainer (VELCRO(TM)). Alternatively, magnetic strips or tabs may be used.

In accordance with a second aspect of the present invention there is provided a door structure including: a door frame having edge portions of which at least some are curved; and a flexible door panel in the form of a unitary plastic sheet which is pivotable between an open configuration and a closed configuration, the door panel being resiliently deformable from a substantially flat configuration to a curved configuration corresponding to the curvature of the curved edge portions of the door frame such that in the closed configuration the door panel is adapted to adopt the curved configuration and in the open configuration, the door panel is freely straightenable to the substantially flat configuration.

Preferably the curved edge portions of the door frame are such that the door panel curves convex outwardly. Most preferably, the door is uniformly curved about an upright axis. The curved edge portions of the door frame may comprise the top and bottom edges of the door frame.

In a most preferred form of the invention, the door structure is embodied in a storage structure having pocket type doors. Suitably, such a storage structure includes a plurality of walls to provide a framework having a front and an interior. The door panel is suitably pivotable relative to the framework between a closed position in which the door panel at least partially covers the front and an open position, and slidable between the open position and a pocketed position in which the door panel is at least partially received within the interior of the framework. Most preferably, in the pocketed position, the door panel is configured in a straighter configuration compared to the curved configuration adopted for the closed position. This provides economy of space in the pocketed position. The auxiliary panel is preferably slidably mounted within the interior. The door panel and the auxiliary panel may comprise a one piece flexible plastic construction with a live hinge dividing the door panel from the auxiliary panel.

The auxiliary panel may be received within a cavity open at the front of the framework, the cavity being defined by two side walls. Most preferably, the edge of one of the side walls defines a hinging edge of the door frame about which the door panel hinges. Furthermore, the door frame preferably includes a side edge along which the outer edge of the flexible door panel may be secured to maintain the curved configuration. Any of the features described above in accordance with the first aspect of the invention may be applied to the second aspect of the invention.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

In order that the invention may be more fully understood one embodiment will now be described by way of example with reference to the drawings in which:

FIG. 11 is a perspective view of a storage unit in accordance with a second preferred embodiment of the present invention as shown from the front;

FIG. 19 is a detail of A of FIG. 11; and

DETAILED DESCRIPTION OF THE PREFERRED EMBODIMENTS

Figure 2:
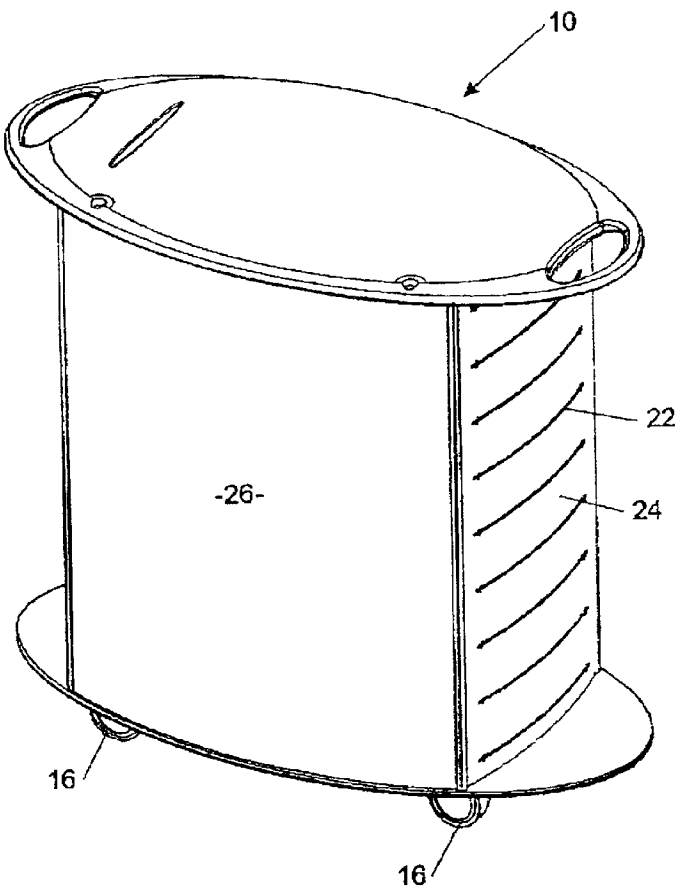
FIG. 2 is a perspective view of the storage unit of FIG. 1, except shown from behind.
Figure 1:
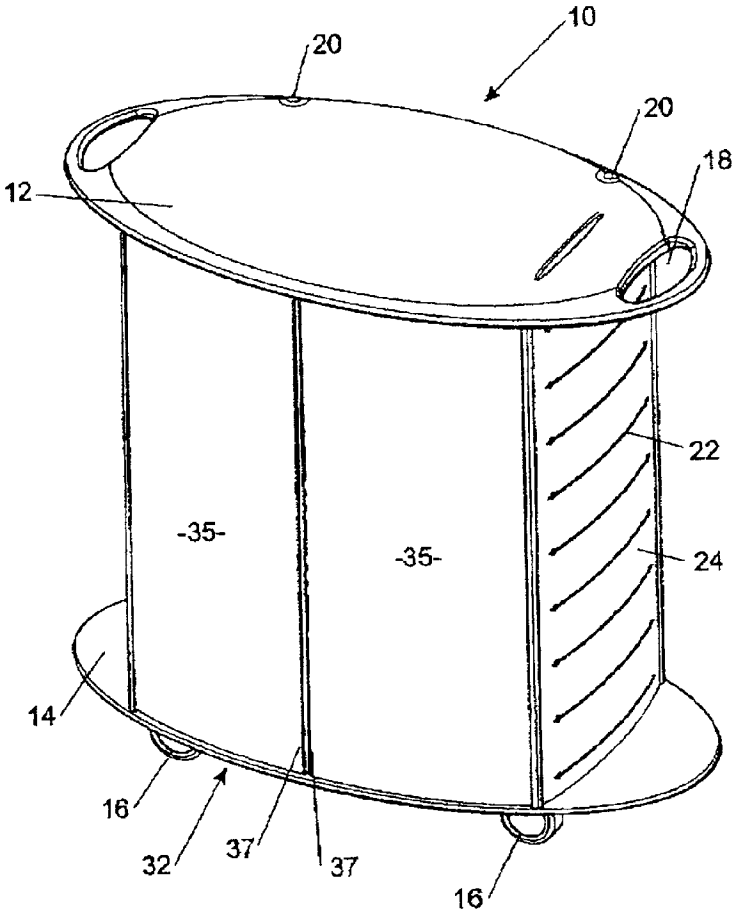
FIG. 1 is a perspective view of a storage unit in accordance with a preferred embodiment of the present invention, as shown from the front.

The storage unit 10 illustrated in FIGS. 1 and 2 includes a top work surface 12, a base 14 which is mounted on castors or wheels 16. As the storage unit 10 is intended to be mobile, the top 12 includes integrally formed handle portions 18 enabling a user to selectively move the storage unit as required. The storage unit 10 may also facilitate attachment of a number of accessories and apertures 20 are specifically provided for this purpose. Furthermore slots 22 provided in the side walls 24 of the storage unit 10 facilitate the attachment of shelves to the sides of the storage unit.

From an appreciation of FIGS. 1 and 2 it can be seen that in plan, the outline of the storage unit 10 is elliptical. Accordingly, the top work surface 12 has an elliptical outline as with the base 14. Extending between the top work surface and the base 14 are two side walls 24 and a back wall 26 which generally define a framework for a storage space inside the storage unit 10. The framework defines an interior 30 (See FIG. 3) and a front 32 which in FIG. 1 is closed by a pair of door panels 35. It will be seen from FIG. 1 that the door panels 35 when in the closed configuration as illustrated, adopt a curved configuration, corresponding to the curvature of the corresponding edge of the top work surface 12 and the base 14. The door panels 35 hinge about live hinges 37 disposed centrally of the front of the framework.

Figure 3:
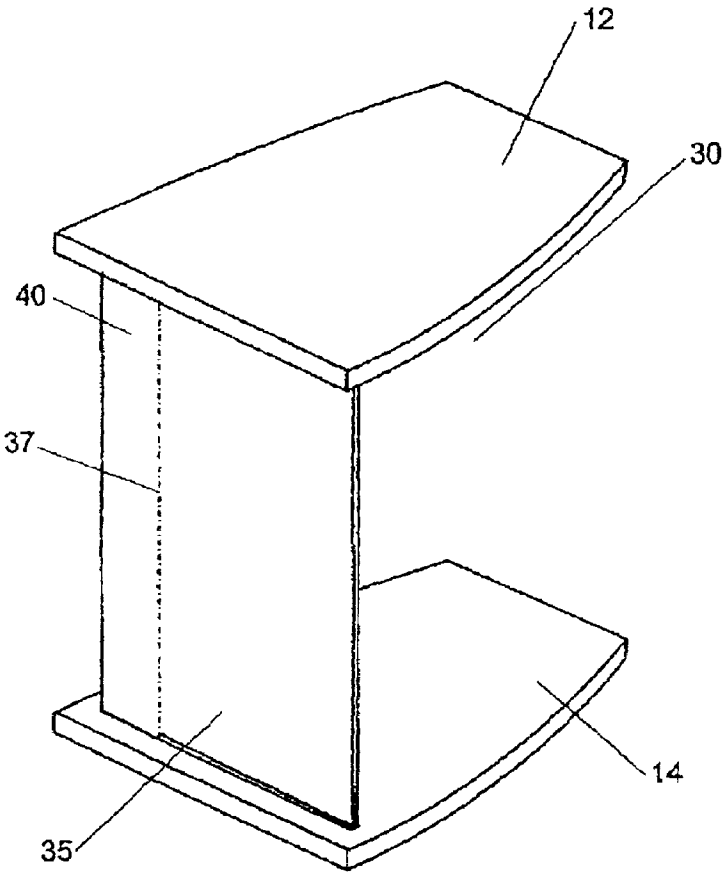
FIG. 3 is a perspective view of a portion of the storage unit illustrated in FIG. 1, shown with the door panel in the pocketing position.
Figure 5:
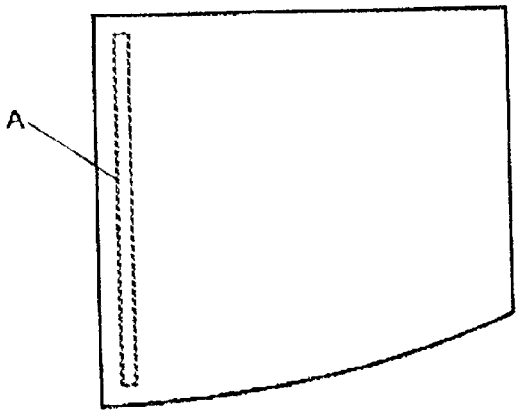
FIG. 5 is a diagrammatic sketch of a top view of the portion illustrated in FIG. 3 illustrating the door in the pocketed position.
Figure 6:
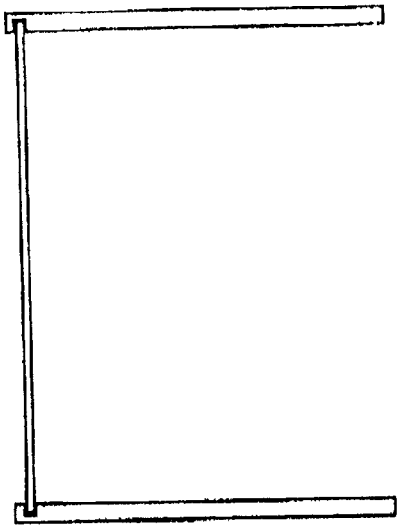
FIG. 6 is a diagrammatic front view of the portion of the storage unit shown in FIG. 5.

Referring to FIG. 3, only a portion of the storage unit 10 is illustrated, sufficient to show the operation of a single door panel 35. For clarity, the rear wall 26 and one of the side walls 24 is also removed. FIG. 3 illustrates the door panel 35 in a pocketed configuration whereby it is received within the interior 30 of the storage structure 10. The door panel 35 is part of a unitary plastic sheet which also incorporates an auxiliary panel 40. Between the auxiliary panel 40 and the door panel 35, a region of reduced thickness is provided which defines the live hinge 37. The plastic sheet forming the door panel 35 and the auxiliary panel 40 is resiliently deformable to enable the door panel 35 to adopt the curved configuration as illustrated in FIG. 1. An appropriate maternal is polypropylene.

Figure 4:
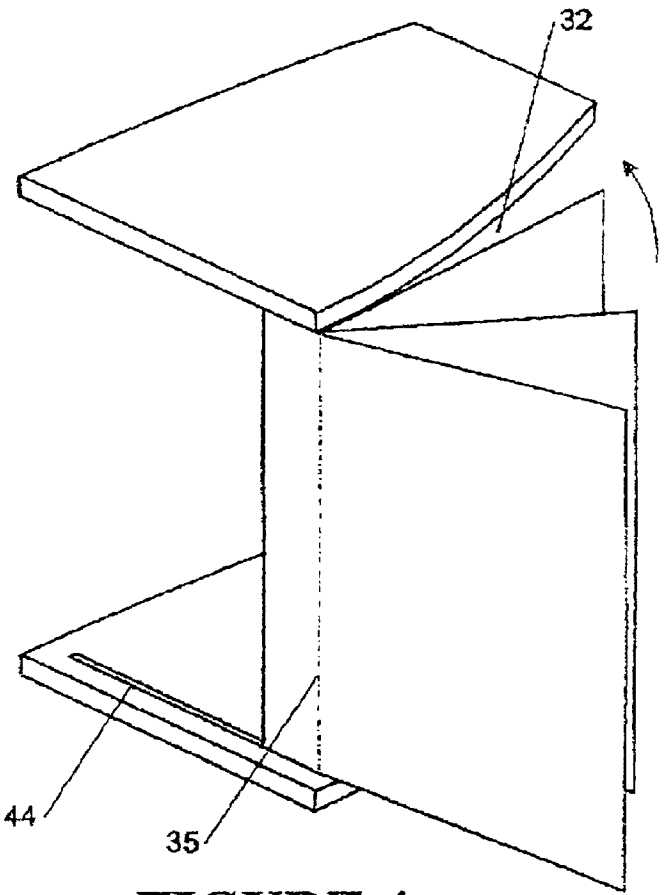
FIG. 4 is a perspective view of the portion shown in FIG. 3, except with the door panel illustrated as closing.
Figure 7:
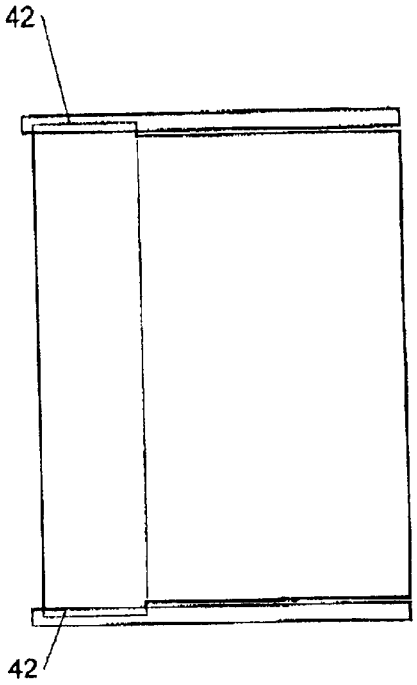
FIG. 7 is a diagrammatic side view of the portion of the storage unit shown in FIG. 5.
Figure 8:
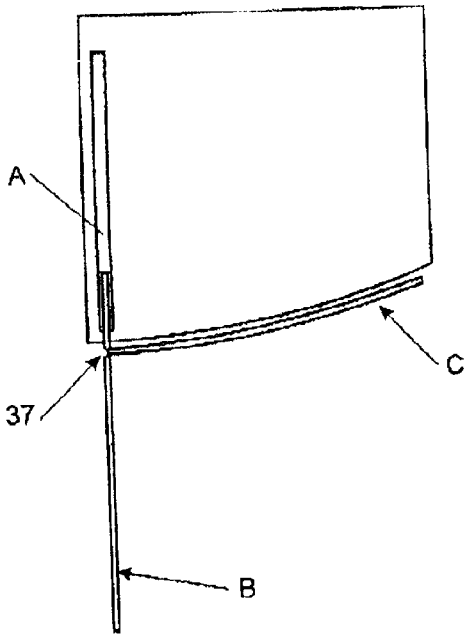
FIG. 8 is a diagrammatic top view of the storage unit illustrating the door in the open position and in the closed position.
Figure 9:
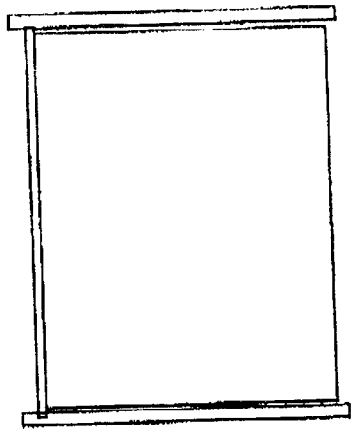
FIG. 9 is a schematic front view of the portion of the storage unit shown in FIG. 8 in the closed configuration.
Figure 10:
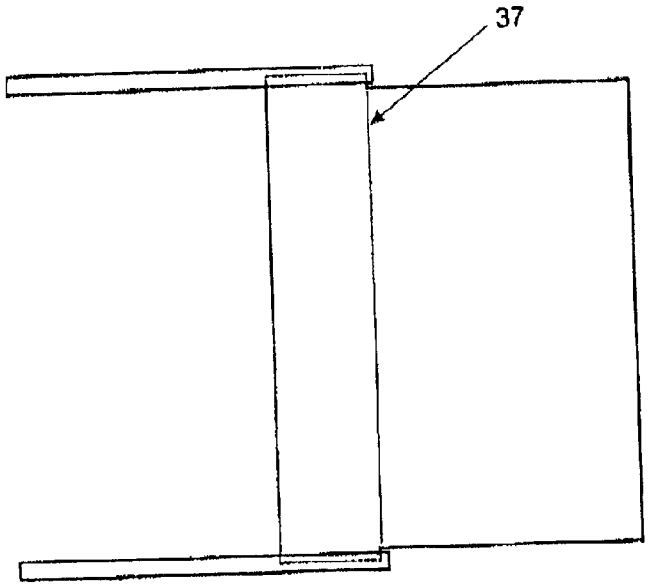
FIG. 10 is a schematic side view of the portion of the storage unit illustrated in FIG. 8 in the open configuration.
Figure 18:
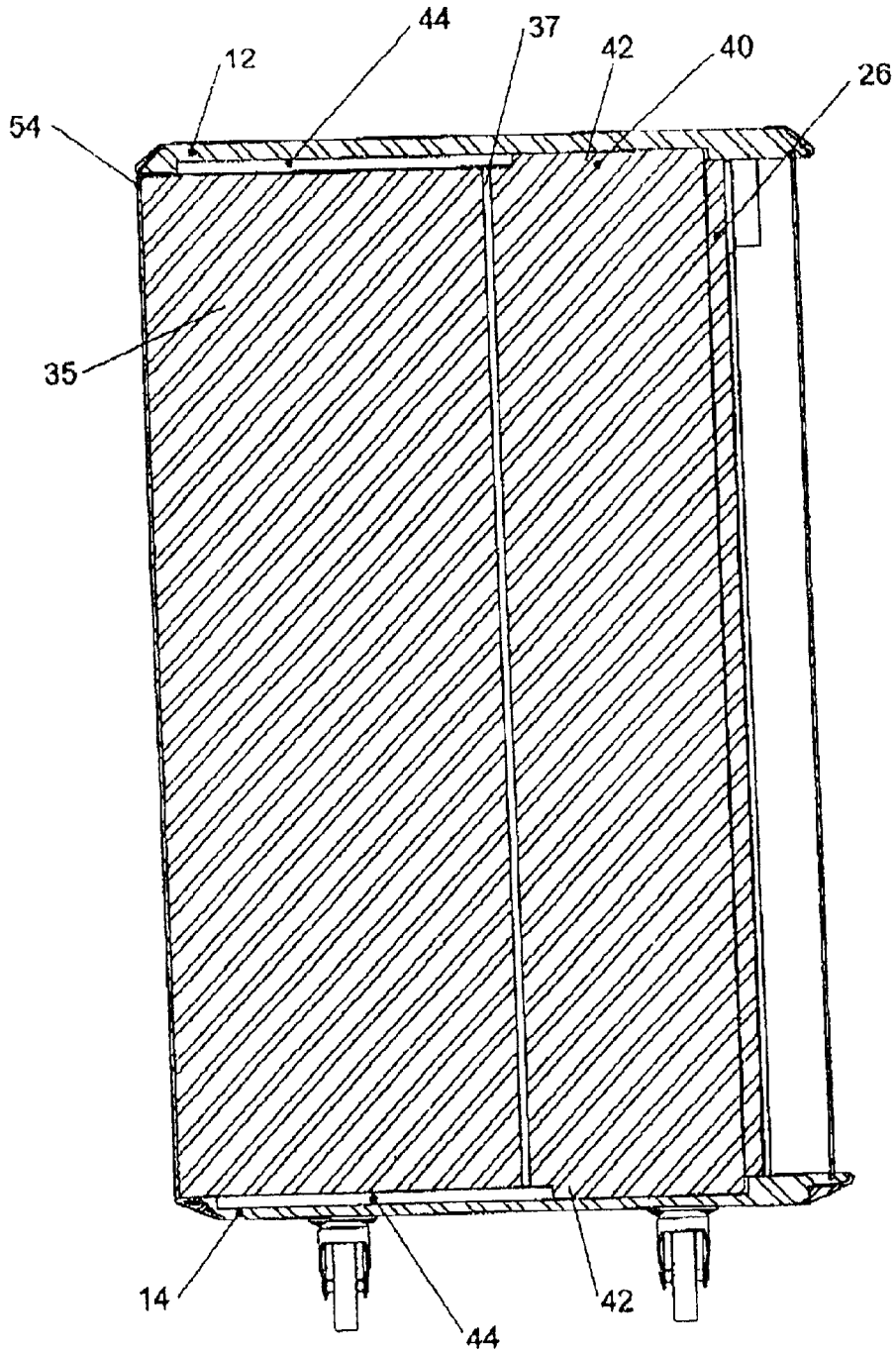
FIG. 18 is a sectional view through a door panel when in the pocketed configuration as shown in FIG. 12.

As can be seen from FIG. 7, the auxiliary panel 40 has upper and lower tabs 42 which are slidingly received within respective upper and lower guide slots 44. The lower guide slot 44 can be seen from an inspection of FIG. 4. With the tabs 42 slidingly received in respective guide slots 44, the auxiliary panel 40 is able to slide from a pocketed position A in which the door panel 45 is wholly received within the interior 30 of the storage structure to an open position as depicted by B as shown in FIG. 8. Once the door panel reaches the open position, the tabs 42 of the auxiliary panel reach the end of their travel within guide slots 44, the guide slots 44 terminating a short distance before the front edge of the top work surface 12 and the base 14 as can be seen from FIG. 18. At this point, the door panel 35 will not be permitted to slide further outwards. As such, as shown in FIG. 8 once the door panel 35 reaches the position indicated by B, the position of the live hinge 37 will correspond approximately with the front of the storage unit.

The door panel 35 may then be pivoted about live hinge 37 until the door panel 35 reaches the closed position as depicted by C in FIG. 8. It can be seen that the door panel 35 adopts a curvature corresponding to the curvature of the front edge of the top work surface 12 and the base 14. The door panel 35 may bear against upper and lower curved edge portions of the door frame, thereby defining the appropriate curvature for the door panel 35.

FIGS. 11 to 20 illustrate a second preferred embodiment of the present invention which to all intents and purposes is very similar to the first embodiment illustrated in FIGS. 1 to 10, except that the second embodiment includes provision of a retainer in the form of a latch. The drawings of this embodiment also provide further detail of various parts of the storage unit 10' and like numerals represent like parts.

Figure 12:
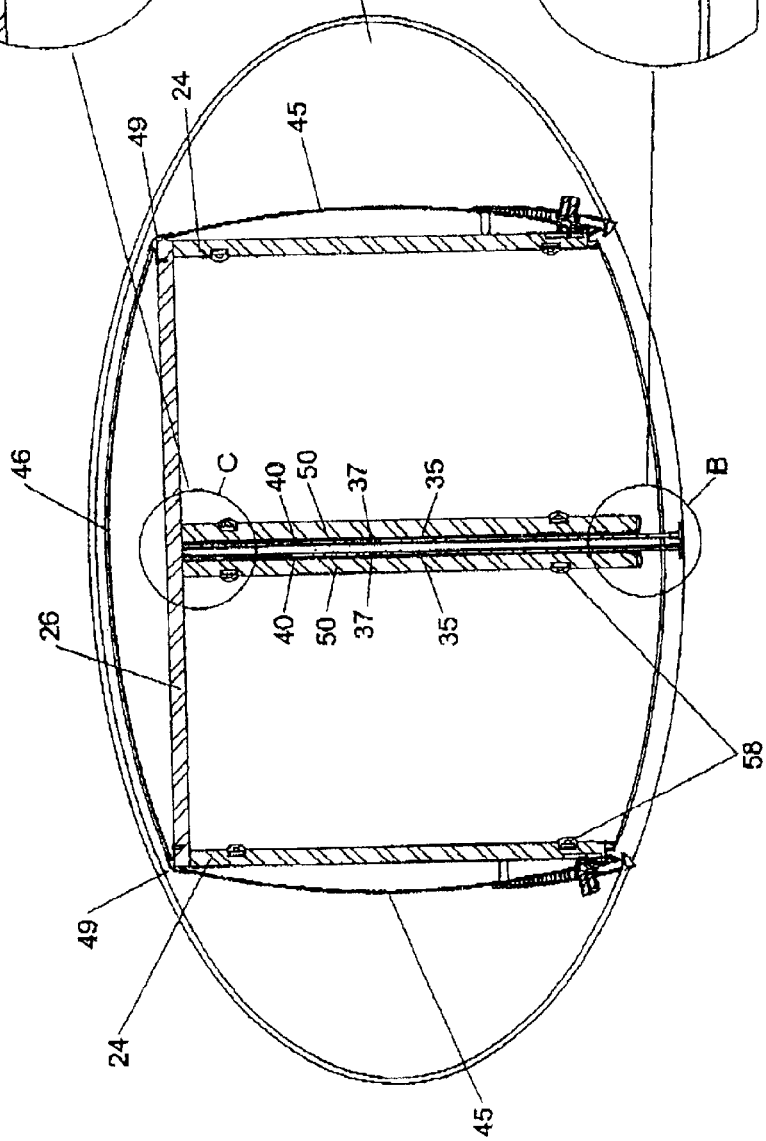
FIG. 12 is a sectional view of the storage unit illustrated in FIG. 11 from above, the door panels being in the open configuration.

Referring to FIG. 12, greater detail of the framework of the storage unit 10' can be seen. As already explained, the framework comprises side walls 24, rear wall 26, base 14 and top 12 which has been removed from view in FIG. 12. Additionally, the side walls 24 and the rear wall 26 are shrouded with steel covers 45, 46. The side covers 45 are each held between an extruded side wall end cap 48 which can be seen more clearly in FIG. 20 and a corner extrusion 49 as shown in FIG. 12. The back cover is 46 held in position between the corner extrusions 49. It can be seen that the back cover 46 conforms in curvature to the curvature of the adjacent edge of the base 14.

FIG. 12 also illustrates the two mid walls 50 between which is provided a pocket into which the integral door panels 35 and wall panels 40 can be received in the pocketed configuration. Detail B (FIG. 13) illustrates the forward end of the mid walls 50 which have extruded side wall edge caps 52. Additionally, the outer end of the door panels 35 also have extruded door panel edge caps 54 which can also be seen in greater detail in FIG. 20.

Figure 14:
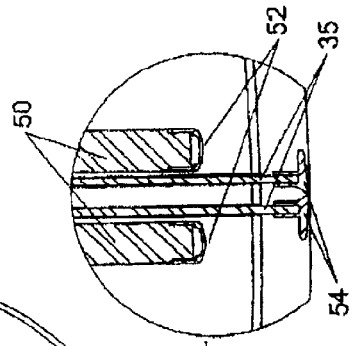
FIG. 14 is an enlarged detail of C of FIG. 12.

FIG. 14 illustrates detail C in greater detail. The inner ends of the auxiliary panels 40 have extruded strengthening caps 56.

As can be seen from FIG. 12, the outer walls 24 and the mid walls 50 have vertically aligned shelf plugs 58. Such vertically aligned shelf plugs 58 are provided at various levels within the interior of the storage unit 10' to provide support for a series of shelves (not shown).

Figure 13:
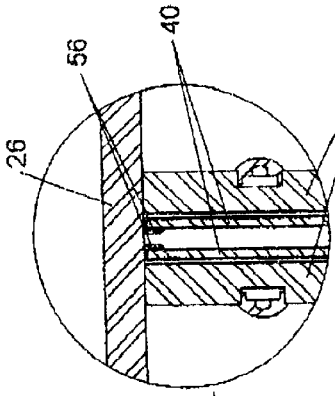
FIG. 13 is an enlarged detail of B of FIG. 12.
Figure 16:
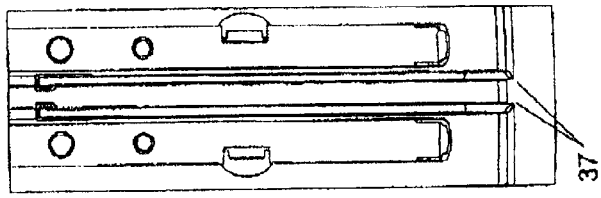
FIG. 16 is an enlarged detail of C of FIG. 15.
Figure 17:
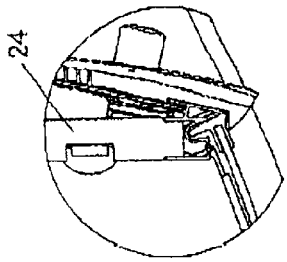
FIG. 17 is an enlarged detail of D of FIG. 15.
Figure 15:
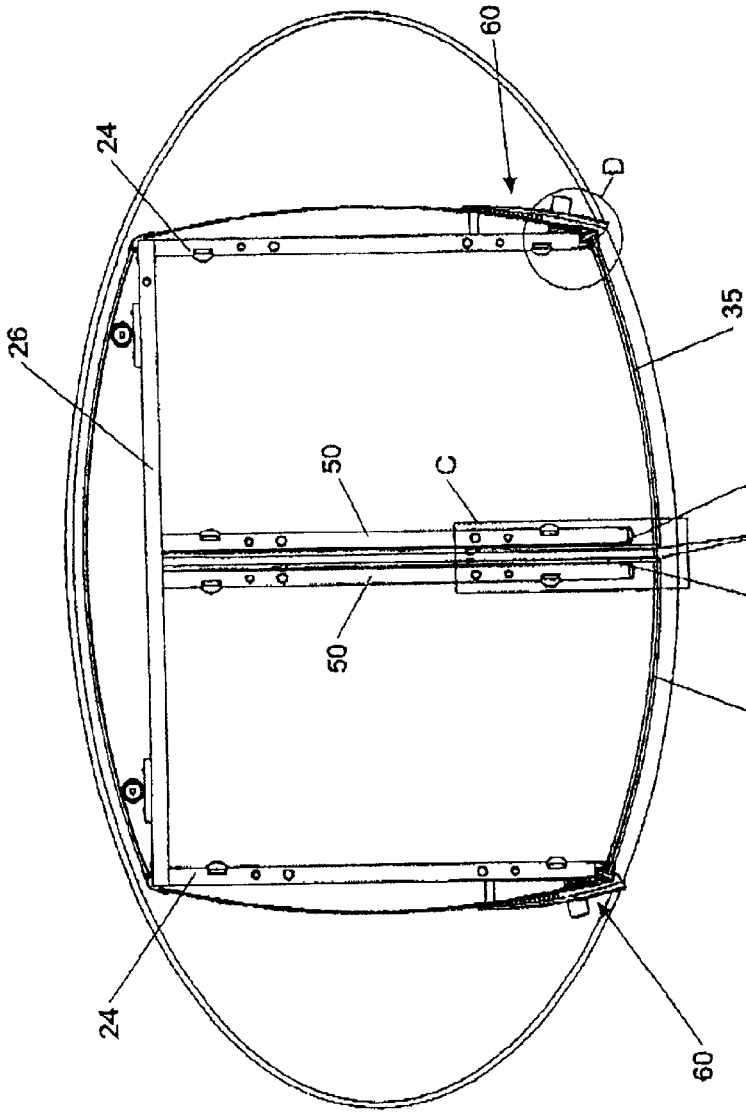
FIG. 15 is a plan view of the storage unit of FIG. 11 with the top removed and with the doors shown in the closed position.

While FIGS. 12 to 14 illustrate the door panels 35 and auxiliary panels 40 in the pocketed configuration, FIGS. 15 to 17 illustrate the door panels 35 and auxiliary panels 40 in the closed configuration. Each door panel 35 is retained in the closed configuration by means of a latch 60 which is shown in greater detail in FIG. 17 as well as FIG. 20.

Figure 20:
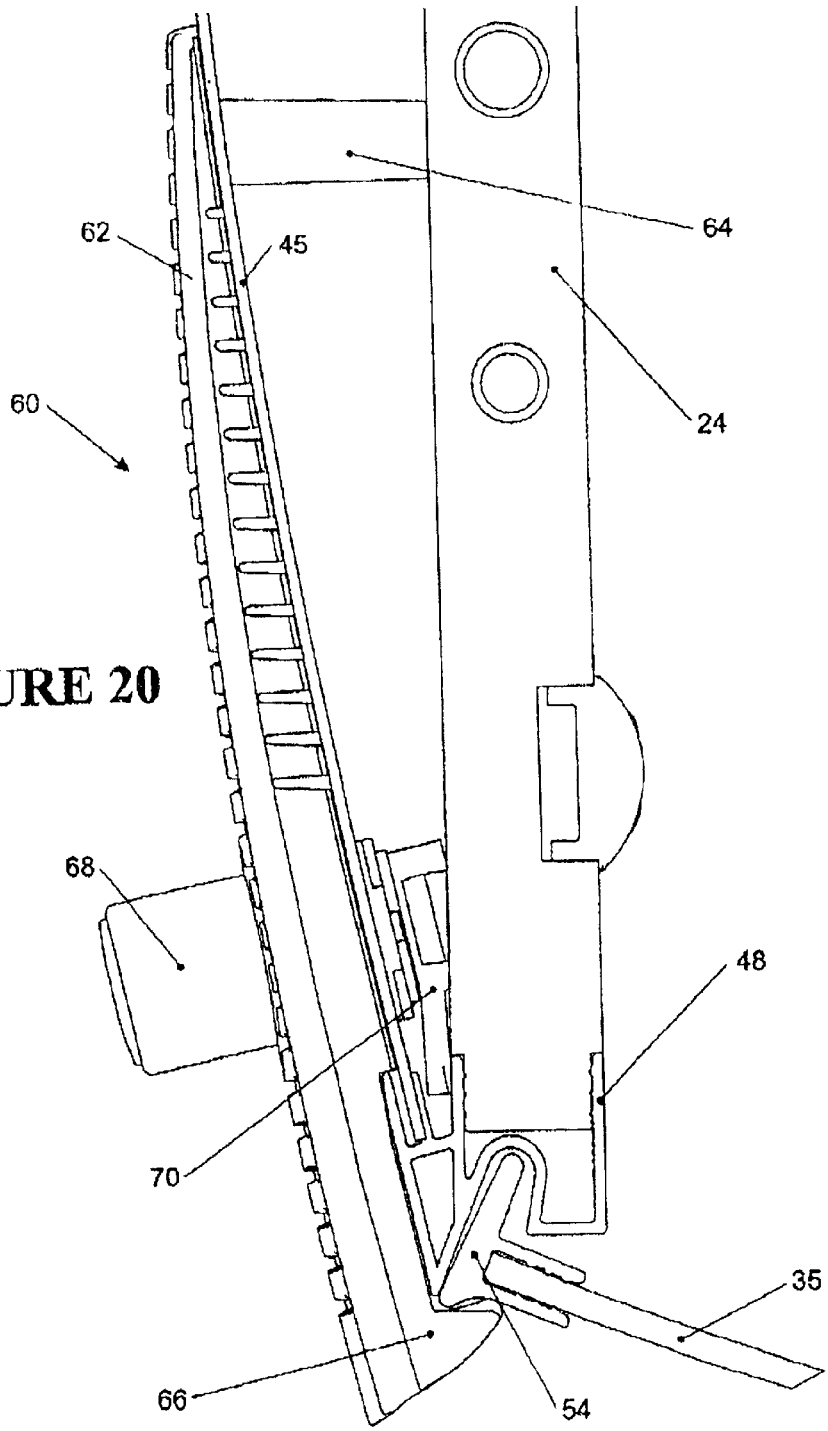
FIG. 20 is an enlarged detail of a latch to retain the door panel in the closed configuration.

Referring to FIG. 20, it can be seen that each latch 60 comprises a latch body 62 adjacent to the outer side of the side cover 45. The inner end of the latch body 62 is affixed to the side wall 24 by a latch fixing boss 64. The outer end of the latch body 62 comprises a latch head 66 defining a projection which extends toward the door panel 35. The latch body 62 is flexible. In the closed configuration as shown, the projection of the latch head 66 cooperates with the door panel edge cap 54 to retain the door panel 35 in the closed configuration. The latch 60 also comprises a lock 68 which operates a locking cam 70. When in the unlocked state, the outer end of the latch 60 is permitted to flex away from the side wall 24 and the corresponding side wall edge cap 48 to enable the door panel edge cap 54 to be released from its nested configuration within a channel of the side wall edge cap 48. In the locked configuration of the lock 68, the lock cam 70 cooperates within a channel of the side wall end cap 48 to prevent the outer end of the latch body 62 from moving outwardly, thereby retaining the door panel edge cap 54 within its nested configuration and hence the door panel 35 in the closed configuration.

The foregoing describes only one embodiment of the present invention and modifications may be made thereto without departing from the scope of the invention.

What is claimed is:

1. A storage structure comprising:

a framework defining an interior including a storage space and an opening to the storage space wherein the framework includes a curved contour; and a closure comprising:

an auxiliary portion which is slidably mounted substantially within the interior of the framework; and a door panel hingedly connected to the auxiliary portion by means of a hinge portion whereby the door panel is pivotable about the hinge portion from a closed position in which the door panel at least partially covers the opening to an open position, and movable from the open position to a pocketed position in which the door panel is at least partially received within the interior of the framework, wherein the door panel is resiliently deformable to adopt a curved configuration conforming to the curved contour of the framework.

2. The storage structure as claimed in claim 1 wherein the auxiliary portion is in the form of an auxiliary panel and the auxiliary panel and the door panel are integrally formed.

3. The storage structure as claimed in claim 2 wherein the door panel and the auxiliary panel comprise a unitary plastic sheet and the hinge portion is in the form of a living hinge which forms the divide between the door panel and the auxiliary panel.

4. The storage structure as claimed in claim 1 wherein the interior of the storage structure is further provided with a separate cavity adjacent the storage space within which the auxiliary portion is slidably mounted and into which the door panel is movable when in the pocketed position.

5. The storage structure as claimed in claim 4 wherein the cavity is defined by two walls, the inner one relative to the opening defining a hinging edge.

6. The storage structure as claimed in claim 5 wherein the door panel and the auxiliary portion are extendible from the cavity until the hinge is aligned with the hinging edge and a stop is provided to limit the outward travel of the door panel and the auxiliary portion from the cavity.

7. The storage structure as claimed in claim 4 wherein the cavity is substantially rectilinear such that the resiliently deformable door panel is straightened to be received within the cavity.

8. The storage structure as claimed in claim 1 wherein the curved contour of the storage unit is such that the door panel curves convex outwardly in the closed position.

9. A door structure comprising:

a door frame having edge portions of which at least some are curved; and a flexible door panel in the form of a unitary plastic sheet which is pivotable between an open configuration and a closed configuration, the door panel being:

resiliently deformable from a substantially flat configuration to a curved configuration corresponding to the curvature of the curved edge portions of the door frame such that in the closed configuration the door panel is adapted to adopt the curved configuration and in the open configuration the door panel is freely straightenable to the substantially flat configuration; and slidable relative to the door frame when in the open configuration.

10. The door structure as claimed in claim 9 wherein the curved edge portions of the door frame are such that the door panel curves convex outwardly in the closed configuration.

11. The door structure as claimed in claim 9 wherein the curved edge portions of the door frame are such that the door panel curves uniformly about an upright axis in the closed configuration.

12. The door structure as claimed in claim 10 wherein the curved edge portions of the door frame are such that the door panel curves uniformly about an upright axis in the closed configuration.

13. The door structure as claimed in claim 9 wherein the curved edge portions of the door frame comprise top and bottom edges of the door frame.

14. The door structure as claimed in claim 11 wherein the curved edge portions of the door frame comprise top and bottom edges of the door frame.

15. The door structure as claimed in claim 9 wherein the door structure is embodied in a storage structure having an internal cavity to receive the door panel.

16. The door structure as claimed in claim 10 wherein the door structure is embodied in a storage structure having an internal cavity to receive the door panel.

17. The door structure as claimed in claim 11 wherein the door structure is embodied in a storage structure having an internal cavity to receive the door panel.

* * * * *

UNITED STATES PATENT AND TRADEMARK OFFICE

CERTIFICATE OF CORRECTION

PATENT NO. : 6,779,857 B2
DATED : August 24, 2004
INVENTOR(S) : Waisbrod et al.

It is certified that error appears in the above-identified patent and that said Letters Patent is hereby corrected as shown below:

Column 1,
Line 37, after "storage structure" insert -- or a door structure --.

Column 2,
Line 40, after "hook and loop" change "fastener" to -- fasteners --.

Column 4,
Line 1, after "detail of" change "B" to -- C --.
Line 2, after "detail of" change "C" to -- B --.
Line 63, after "door panel" change "45" to -- 35 --.

Column 5,
Line 39, after "Detail B" change "(FIG. 13)" to -- (FIG. 14) --.
Line 44, before "illustrates" change "FIG. 14" to -- FIG. 13 --.

Signed and Sealed this

Twenty-third Day of August, 2005

JON W. DUDAS
*Director of the United States Patent and Trademark Office*